US011105158B2

(12) United States Patent
Keller et al.

(10) Patent No.: US 11,105,158 B2
(45) Date of Patent: Aug. 31, 2021

(54) DRILL BIT AND METHOD USING CUTTER WITH SHAPED CHANNELS

(71) Applicant: Halliburton Energy Services, Inc., Houston, TX (US)

(72) Inventors: Christopher John Keller, Magnolia, TX (US); William Brian Atkins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 16/509,077

(22) Filed: Jul. 11, 2019

(65) Prior Publication Data

US 2020/0018122 A1 Jan. 16, 2020

Related U.S. Application Data

(63) Continuation-in-part of application No. 29/656,475, filed on Nov. 2, 2018.

(51) Int. Cl.
*E21B 10/567* (2006.01)
*E21B 10/55* (2006.01)

(52) U.S. Cl.
CPC ..... *E21B 10/5673* (2013.01); *E21B 10/55* (2013.01)

(58) Field of Classification Search
CPC ..... E21B 10/5673
See application file for complete search history.

(56) References Cited

U.S. PATENT DOCUMENTS 4,915,182 A 4/1990 Magyari et al.
4,984,642 A * 1/1991 Renard ..... E21B 10/5673 175/430
5,172,778 A * 12/1992 Tibbitts ..... E21B 10/5673 175/420.1
6,220,375 B1 * 4/2001 Butcher ..... B22F 7/06 175/428
6,332,503 B1 12/2001 Pessier et al.
6,779,613 B2 8/2004 Dykstra et al.
(Continued)

FOREIGN PATENT DOCUMENTS

EP 0358526 A2 * 3/1990 ..... B24D 99/00
EP 0351952 4/1994
(Continued)

OTHER PUBLICATIONS

International Search Report and Written Opinion for Application No. PCT/US2019/041435, dated Apr. 10, 2020.

*Primary Examiner* — Robert E Fuller
(74) *Attorney, Agent, or Firm* — Thomas Rooney; C. Tumey Law Group PLLC

(57) ABSTRACT

Systems and methods for wellbore drilling may use one or more cutting elements including a cutting face with one or more channels capable of steering chip cuttings into an intended direction off of the cutting face of the cutting element for drilling operations. A method may comprise rotating a drill bit to extend a wellbore into a subterranean formation, flowing a drilling fluid through the drill bit, and directing a plurality of formation cuttings away from one or more cutting elements of the drill bit by moving the cuttings along one or more channels on at least a portion of a cutting face of the one or more cutting elements.

17 Claims, 7 Drawing Sheets

(56) References Cited

U.S. PATENT DOCUMENTS

| | | | | |
|---|---|---|---|---|
| 8,807,247 | B2 * | 8/2014 | Scott | E21B 10/5735 175/383 |
| 8,991,525 | B2 | 3/2015 | Bilen et al. | |
| 9,243,452 | B2 * | 1/2016 | DiGiovanni | E21B 10/60 |
| 9,376,867 | B2 | 6/2016 | DiGiovanni et al. | |
| 9,821,437 | B2 | 11/2017 | Bilen et al. | |
| 10,041,304 | B2 | 8/2018 | Saini et al. | |
| RE47,369 | E * | 4/2019 | Shen | E21B 10/573 |
| 10,280,688 | B2 | 5/2019 | Dunbar et al. | |
| 10,399,206 | B1 * | 9/2019 | Mortensen | B24D 3/007 |
| 2005/0263944 | A1 * | 12/2005 | Weis | C04B 35/645 264/667 |
| 2011/0031036 | A1 * | 2/2011 | Patel | E21B 10/5673 175/430 |
| 2012/0177772 | A1 * | 7/2012 | Judd | B29C 45/2602 425/542 |
| 2014/0284161 | A1 | 9/2014 | White | |
| 2017/0284161 | A1 | 10/2017 | Zhang | |
| 2019/0338599 | A1 * | 11/2019 | Bellin | E21B 10/5673 |
| 2019/0376346 | A1 * | 12/2019 | Vijayabalan | E21B 10/46 |

FOREIGN PATENT DOCUMENTS

| | | |
|---|---|---|
| EP | 0918135 | 5/1999 |
| EP | 2796660 | 11/2011 |
| GB | 2369841 | 12/2004 |
| JP | 11226806 | 8/1999 |
| WO | 2007-068866 | 6/2007 |

* cited by examiner

DRILL BIT AND METHOD USING CUTTER WITH SHAPED CHANNELS

CROSS REFERENCE TO RELATED APPLICATIONS

This Application claims priority to U.S. Design application Ser. No. 29/656,475, entitled PDC Cutter, filed Jul. 12, 2018, the disclosure of which is incorporated herein by reference.

BACKGROUND

Various types of tools are used to form wellbores in subterranean formations for recovering hydrocarbons such as oil and gas lying beneath the surface. Examples of such tools include rotary drill bits, hole openers, reamers, and coring bits. One common type of drill bit used to drill wellbores is known as a "fixed cutter" or "drag" bit. Rotary drill bits include fixed cutter drill bits, such as polycrystalline diamond ("PDC") cutters.

In conventional wellbore drilling, a drill bit is mounted on the end of a drill string, which may be several miles long. In practice, at the surface of the wellbore, a rotary table or top drive may turn the drill string, including the drill bit arranged at the bottom of the hole to increasingly penetrate the subterranean formation, while drilling fluid is pumped through the drill string. As the drill bit operates and comes into contact with the ground formation, material cut by the drill bit (generally referred to as cuttings, formation cuttings, or chips) is removed from the face of the drill bit and sent up the wellbore via drilling fluid.

On occasion, however, cuttings may become clogged in the system which may result in partial or full blockage of hydraulic operations. It follows that blockage may lead to delays in drilling operations while remedial measures are undertaken to remove the blockage. Such delays are often costly, time consuming, and hamper the efficiency of drilling operations.

BRIEF DESCRIPTION OF THE DRAWINGS

These drawings illustrate certain aspects of some examples of the present disclosure and should not be used to limit or define the disclosure.

DETAILED DESCRIPTION

Figure 1:
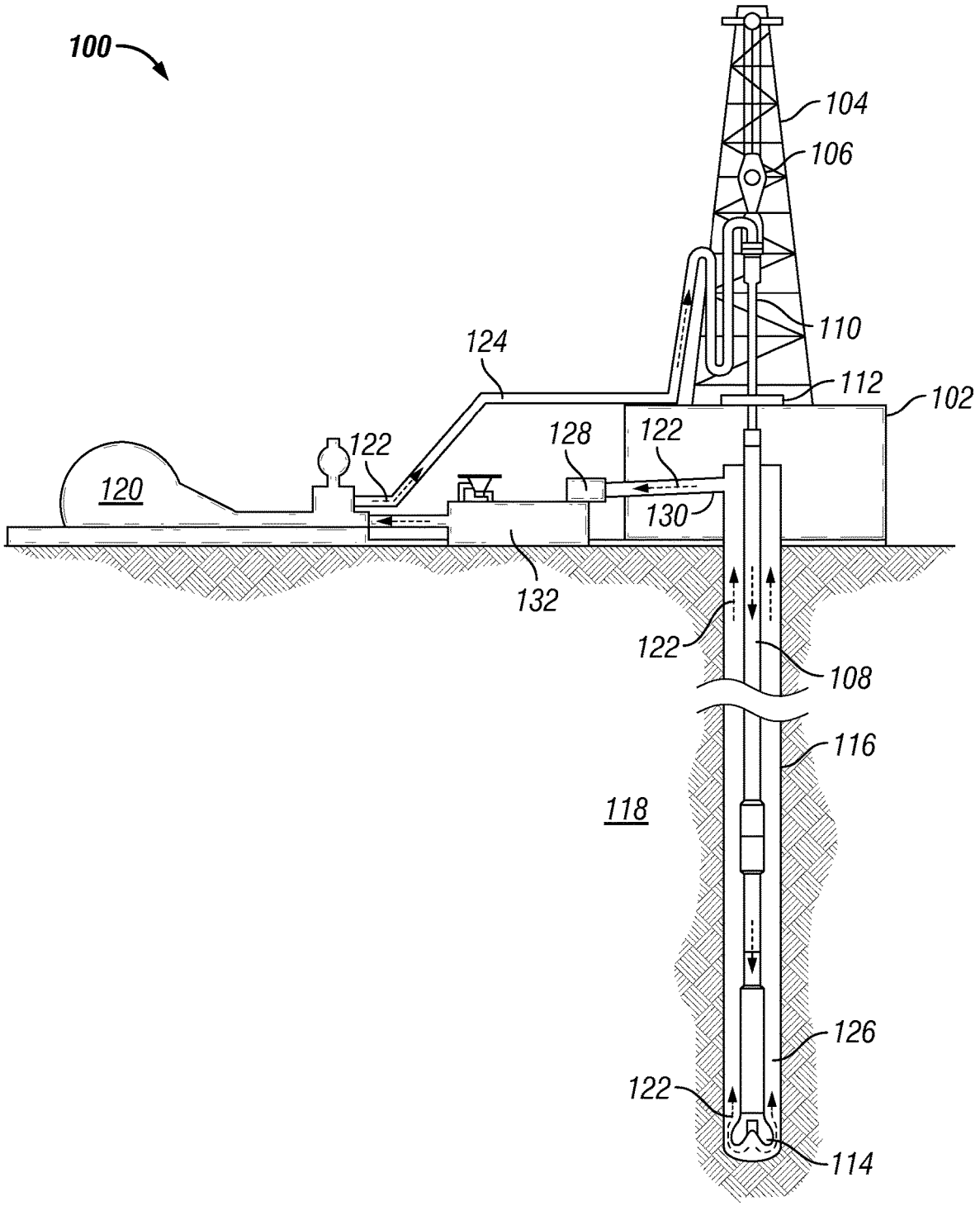
FIG. 1 illustrates a side elevation, partial cross-sectional view of an operational environment in accordance with one or more embodiments of the disclosure.

Provided are systems and methods for wellbore drilling and, more particularly, example embodiments may use of one or more cutting elements including a cutting face with one or more channels capable of steering chip cuttings into an intended direction off of the cutting face of the cutting element for drilling operations.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following description, numerous details are set forth to provide an understanding of the present disclosure. However, it will be understood by those of ordinary skill in the art that the present disclosure may be practiced without these details and that numerous variations or modifications from the described embodiments may be possible. The disclosure will now be described with reference to the figures, in which like reference numerals refer to like, but not necessarily the same or identical, elements throughout. For purposes of clarity in illustrating the characteristics of the present disclosure, proportional relationships of the elements have not necessarily been maintained in the figures.

Specific examples pertaining to the method are provided for illustration only. The arrangement of steps in the process or the components in the system described in respect to an application may be varied in further embodiments in response to different conditions, modes, and requirements. In such further embodiments, steps may be carried out in a manner involving different graphical displays, queries, analyses thereof, and responses thereto, as well as to different collections of data. Moreover, the description that follows includes exemplary apparatuses, methods, techniques, and instruction sequences that embody techniques of the disclosed subject matter. It is understood, however, that the described embodiments may be practiced without these specific details or employing only portions thereof.

FIG. 1 generally illustrates a side elevation, partial cross-sectional view of an operational environment in accordance with one or more embodiments of the disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a wellbore 116 that penetrates various subterranean formations 118.

Figure 2:
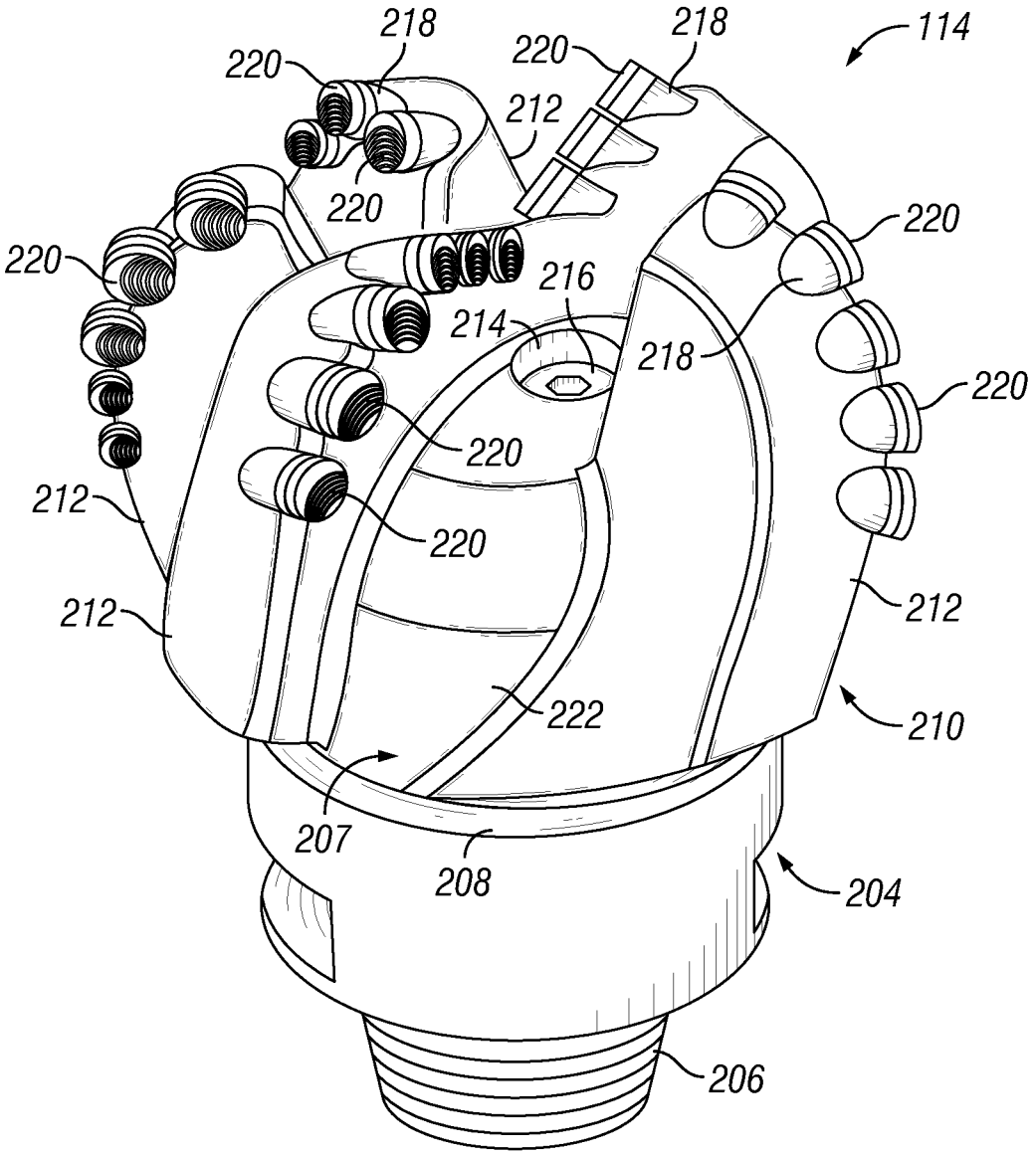
FIG. 2 illustrates an isometric schematic drawing of an exemplary fixed-cutter drill bit in accordance with one or more embodiments of the disclosure.

Drill bit 114, may be of the fixed-cutter type shown in FIG. 2 and employ cutting elements 220, as depicted in FIGS. 3A-11. As will be discussed in more detail herein, the cutting elements 220 may include one or features that facilitate flow of cuttings and other drilling debris away from the cutting elements 220. Referring back to FIG. 1, it will be appreciated that while a drill bit 114 is shown, the drilling assembly may additionally be used to operate hole openers, reamers, and coring bits. A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (i.e., a mud pit). While illustrated as being arranged at the outlet of the wellbore 116 via the annulus 126, those skilled in the art will readily appreciate that the fluid processing unit(s) 128 may be arranged at any other location in the drilling assembly 100 to facilitate its proper function, without departing from the scope of the scope of the disclosure.

The pump 120 may be a high pressure pump in some embodiments. As used herein, the term "high pressure pump" will refer to a pump that is capable of delivering a fluid downhole at a pressure of about 1000 psi or greater. A high pressure pump may be used when it is desired to introduce fluid to a subterranean formation at or above a fracture gradient of the subterranean formation, but it may also be used in cases where fracturing is not desired. In some embodiments, the high pressure pump may be capable of fluidly conveying particulate matter, such as proppant particulates, into the subterranean formation. Suitable high pressure pumps will be known to one having ordinary skill in the art and may include, but are not limited to, floating piston pumps and positive displacement pumps.

In other embodiments, the pump 120 may be a low pressure pump. As used herein, the term "low pressure pump" will refer to a pump that operates at a pressure of about 1000 psi or less. In some embodiments, a low pressure pump may be fluidly coupled to a high pressure pump that is fluidly coupled to the tubular. That is, in such embodiments, the low pressure pump may be configured to convey the fluid to the high pressure pump. In such embodiments, the low pressure pump may "step up" the pressure of the fluid before it reaches the high pressure pump.

It is also to be recognized that the drilling fluids may also directly or indirectly affect the various downhole equipment and tools that may come into contact during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 1.

FIG. 2 illustrates an isometric schematic drawing of an exemplary fixed-cutter drill bit 114 that may employ the principles of the present disclosure. Fixed-cutter drill bit 114 may have a bit body 210. In some embodiments, the bit body 210 may be formed by a metal-matrix composite (e.g., tungsten carbide reinforcing particles dispersed in a binder alloy). As used herein, the term "drill bit" encompasses rotary drag bits, drag bits, fixed-cutter drill bits, and any other drill bit having a bit body and capable of incorporating the teachings of the present disclosure. A plurality of indentations or pockets 218 are formed in the bit body 210 and are shaped or otherwise configured to receive cutting elements 220 as described herein. Bit body 210 includes a plurality of cutting elements 220 according to at least some embodiments of the present disclosure. The cutting elements 220 may be the same as or similar to the cutting element 220 of FIG. 3A. It will be appreciated that cutting element 220 may be comprised of any number of suitable materials including a PDC composition.

With continued reference to FIG. 2. drill bit 114 may include a metal shank 204 with a mandrel or metal blank 207 securely attached thereto (e.g., at weld location 208). The metal blank 207 extends into bit body 210. The metal shank 204 includes a threaded connection 206 distal to the metal blank 207. Bit body 210 may include a plurality of cutter blades 212 formed on the exterior of the bit body 210. Cutter blades 212 may be spaced from each other on the exterior of the bit body 210 to form fluid flow paths or junk slots 222 therebetween.

As illustrated, the plurality of pockets 218 may be formed in the cutter blades 212 in predetermined positions. A cutting element 220 may be securely mounted (e.g., via brazing) in each pocket 218 to engage and remove portions of a subterranean formation during drilling operations. More particularly, each cutting element 220 may scrape and gouge formation materials from the bottom and sides of a wellbore during rotation of the drill bit 114 by an attached drill string. A nozzle 216 may be positioned in each nozzle opening 214 and positioned to clear cuttings/chips of formation material from cutting elements 220 through evacuation features of the bit 114, including junk slots 222. bit body 210 may further include a plurality of cutter blades 212 that are separated by the junk slots 222. As the drill bit 114 operates and comes into contact with the ground formation, cuttings are removed from the face of the drill bit 114 and sent up the wellbore via drilling fluid. However, cuttings may become clogged in the system which may result in partial or full blockage of hydraulic operations.

During drilling operations, cuttings are directed toward higher fluid velocities to accelerate cuttings removal. For example, the center of the bit 114 may experience low fluid velocities which may cause poor cutting removal. Accordingly, the cutting element 220 may include one or more features that can facilitate cutting removal. By aligning flow channels (e.g., channels 328 on FIGS. 3A and 3B) to circulate the cuttings toward the annulus, for example, the cuttings may be directed toward higher fluid velocities and increased efficiency of removal.

Figure 3A:
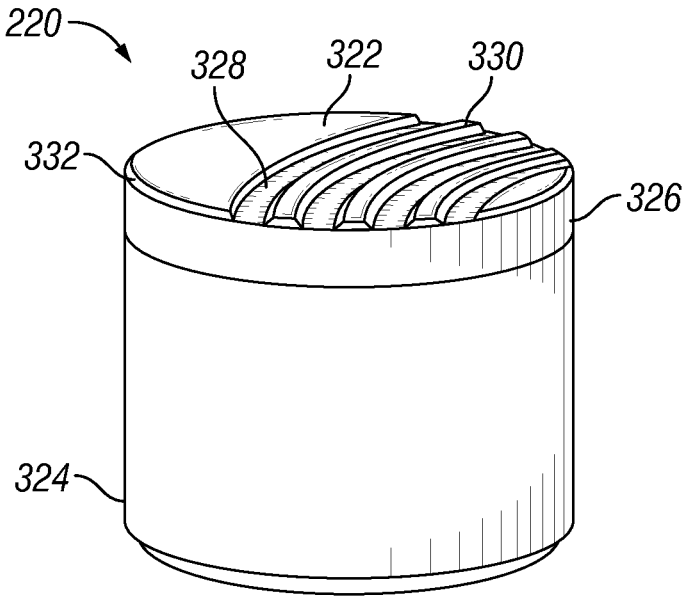
FIG. 3A illustrates a three-dimensional perspective view an example cutting element that may be used with the fixed-cutter drill bit of FIG. 2 in accordance with one or more embodiments of the disclosure.

Turning to FIGS. 3A and B, a three-dimensional perspective view and exemplary top view, respectively, of cutting element 220 that may be used with the fixed-cutter drill bit 114 of FIG. 2 are illustrated. While cutting element 220 is shown with respect to drill bit 114, it will be appreciated that cutting elements 220, as discussed herein, are not limited to use with a fixed-cutter drill bit and may be utilized on any downhole tool, such as drilling casing tools, reaming casing tools, hole openers, core heads, coring bits, and back-up cutters.

As shown, cutting element 220 may include a cutting face 322, a cylindrical side surface 324, where the cutting face 322 may reside on an outer portion of a diamond infused surface 326. Cutting face 322, further may include one or more channels 328 which proscribe a curved arc that spans at least two portions of the periphery of the cutting face 322. A portion of the cutting face 322 that sits above the channels are cutting face ridges 330. The channels 328 and cutting face ridges 330 of the cutting element 220, are operable to influence the direction of formation chip flow over the face of the cutting element 220 via drilling fluid. As described above, moving cuttings away from the drill bit 114 and cutting element 220 surface, and into one or more junk slots 222, in a directed manner increases drilling efficiency and reduces the likelihood of clogs. As shown, cutting face ridges 330 are chamfered on both sides, though it will be appreciated that according to some embodiments, the channels 328 and cutting face ridges 330 are not defined by a chamfered edge. Any suitable technique may be used for forming channels 328 in cutting faces 322. For example, channels 328 may be formed during a high pressure/high temperature process or via later removal of a portion of cutting face 322 surface following a high pressure/high temperature formation process. Suitable processes for removing material from the cutting face 322 include grinding, electrical discharge machining, and laser ablation.

Figure 3B:
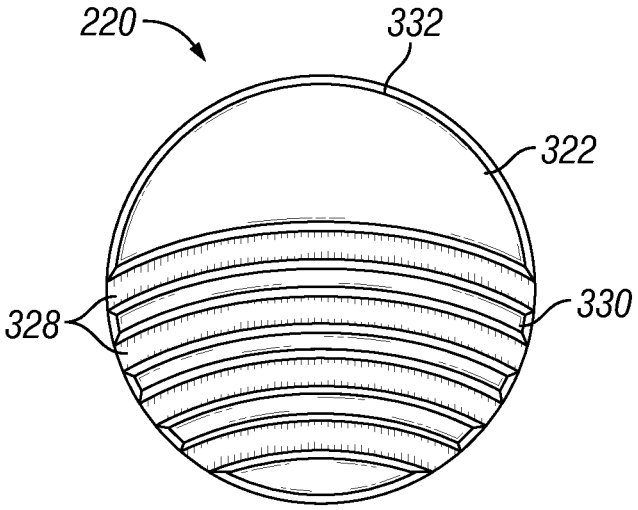
FIG. 3B illustrates an exemplary top view of the cutting element shown in FIG. 3A in accordance with one or more embodiments of the disclosure.

As shown, cutting face 322 includes a periphery with a chamfered edge 332. Some embodiments according to the present disclosure do not include a chamfered edge, however. It will be appreciated that the depth, spacing, and number of channels 328 may vary according to the type of formation and intended use of the drill bit (e.g., drill bit 113 on FIG. 2). In some embodiments, cutting element 220 may feature different channel attributes, such as bevel steepness, use of multiple chamfers, number of channels, and the depth of the channels. Additionally, while the channels 328 depicted in FIGS. 3A and 3B, are generally arc or ring shaped, it will be appreciated that other shapes or partial shapes may be used including ellipsoid, ellipsoid, ovals, ovals, cassini ovals, s-shaped, or a portion thereof. According to some embodiments, the depth of one of more channels 328 may be defined as comprising a minimum end of the chamfer, however, in other embodiments it may not exceed half the thickness of the cutting face 322.

The shape of the channels 328 may be defined by the type of rock to be drilled/cut. For example, if cutting a relatively a soft formation, one or more of the channels 328 may include one or more shapes with minor/little radii. Additionally, it will be appreciated that the quantity of channels 328 may be defined by the depth of the cutting face 322 of the cutting element 220. In some embodiments, one or more of the channels 328 may cover all, or a majority of cutting face 322 such that there are substantially not flat portions of cutting face 322. According to some embodiments, one or more of the channels 328 are spaced apart on the cutting face 322 at a uniform distance. In other embodiments, one or more of the channels 328 may maintain a uniform, or consistent width apart, while according to other channel 328 examples, the width and distance of the spacing between the one or more of the channels 328 may converge, diverge, and or taper from a first end towards a second end.

According to some embodiments, channels 328 may cover all or a large portion of the cutting face 322 of the cutting element 220. According to other embodiments, and the type of surface to be drilled/cut, it will be appreciated that channel 328 coverage of the cutting face 322 or the cutting element 220 may remain at or around 80%. It will be appreciated that, for drilling of soft formations, channels 328 with a smaller radius leading the sharp corners may be used. It will be further appreciated that, for drilling harder formations, channels 328 with a larger radius shape and fewer channels may be used.

The depth of the channels 328 on cutting face 322, may differ, be constant, or vary. According to some embodiments, the depth of one the channels 328 may be at a first value at a first portion of the cutting face 322 and graduate to a deeper, or greater value at a second portion of the cutting face 322 periphery, such that the depth of a single channel 328 may vary. Channel depth may further be characterized as extending completely across the cutting face 322 from one portion of the perimeter edge another portion of the perimeter edge of the cutting face 322. By way of non-limiting examples, one or more of the channels 328 may extend from a perimeter edge portion on a lateral side to a perimeter edge portion on a medial side of cutting face 322. It will be appreciated that according to some embodiments, one or more of the channels 328 also may have a width that is substantially constant along the depth direction, i.e., the slot or opening of one or more of the channels 328 may have substantially parallel channel sidewalls such that a cross-sectional shape of the slot is generally rectangular. It will also be noted that, according to other embodiments, the width may vary along the depth direction of one or more of the channels 328. For example, the slot of one or more of the channels 328 may have converging sidewalls moving from one portion of the perimeter edge of the cutting face 322 to another portion of the perimeter edge.

It should also be appreciated that the term channel, as used herein, in describing the channels 328, may be used interchangeably with the term groove. Other aspects of the channel 328*s*, cutting face ridges 330, and cutting face 322 according to the present disclosure include polishing on one or more surfaces but not on other surfaces to reduce, or increase, friction to suit a particular use. Channels 328 may also take the cross-sectional profile shape of slots, bumps, treads, castellating ridges, and planar, semi-planar, or non-planar shapes.

FIGS. 4-11 illustrate three-dimensional perspective views of alternative embodiments of cutting elements in accordance with the present disclosure. It is to be appreciated that the shapes, orientations, and configurations of the channels may be symmetric or asymmetric on the cutting face 322. Referring to FIGS. 5, 7, 8 and 10, a symmetrical pattern of spaced-apart circular regions of channels 328 and cutting face ridges 330 is shown. In FIGS. 4, 6, 9, and 11, like FIGS. 3A and 3B, an asymmetrical pattern of circular regions is shown comprising only a portion of cutting face 322. It should be noted that while configurations including circular, curved, and arcuate examples are shown, other channel 328 and cutting face ridge 330 shapes may also be used on the cutting face 322.

Figure 4:
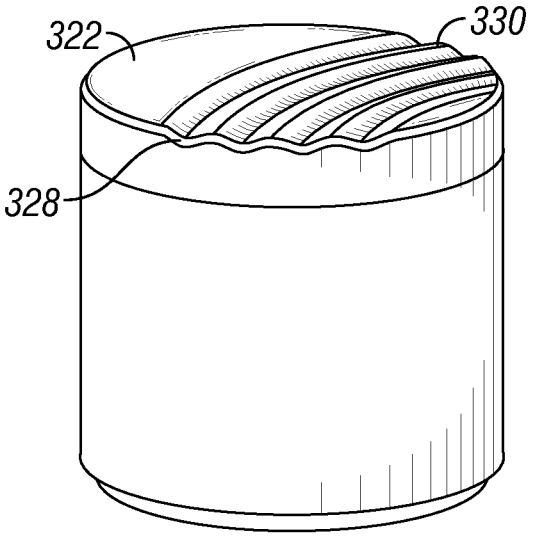
FIGS. 4-11 illustrate three-dimensional perspective views of alternative embodiments of cutting elements in accordance with the present disclosure.

FIG. 4 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form an asymmetrical pattern of circular regions comprising only a portion of cutting face 322. The portion of the cutting face 322 that sits above channels 328 comprise cutting face ridges 330. As shown, cutting face ridges 330 form channels 328 generally comprising a v-shaped profile.

Figure 5:
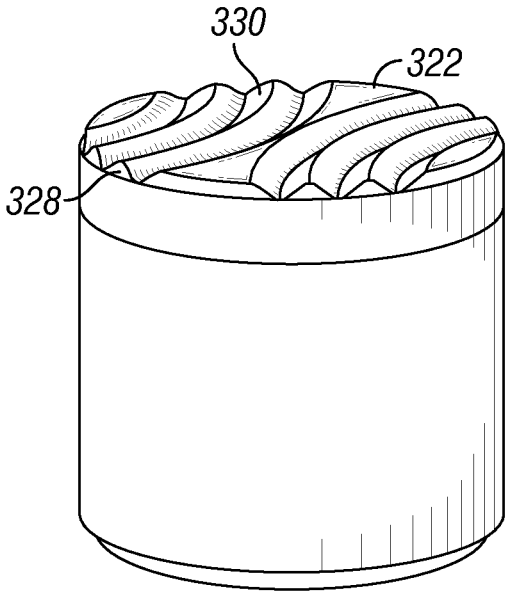

FIG. 5 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form a symmetrical pattern of spaced-apart circular regions of channels 328 and cutting face ridges 330 is shown in a configuration that comprises a majority of the cutting face 322. As illustrated, the one or more channels 328 may define two separate spaced-apart circulate regions of channels 328. As shown, cutting face ridges 330 form channels 328 generally comprising a v-shaped profile. The pitch, or slope of the cutting face ridges 330 in FIG. 5 is greater than those depicted in FIG. 4.

Figure 6:
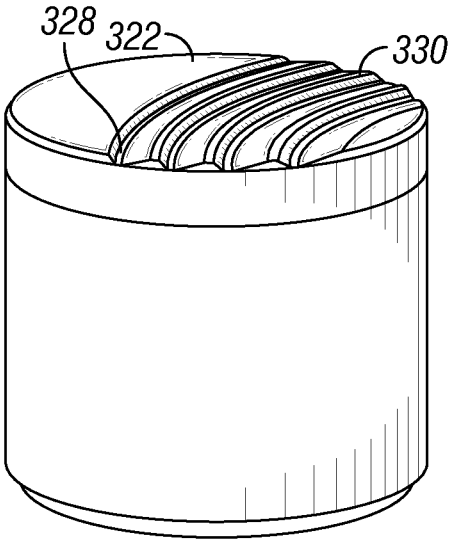

FIG. 6 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form an asymmetrical pattern of circular regions comprising only a portion of cutting face 322. As shown, cutting face ridges 330 form channels 328 generally comprising a multi-faceted profile shape where one a first channel side is longer than a second channel side.

Figure 7:
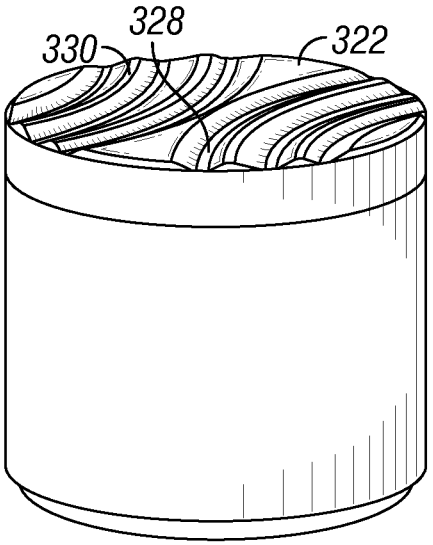

FIG. 7 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form a symmetrical pattern of spaced-apart circular regions of channels 328 and cutting face ridges 330 is shown in a configuration that comprises a majority of the cutting face 322. As shown, cutting face ridges 330 form channels 328 generally comprising a multi-chamfered profile.

Figure 8:
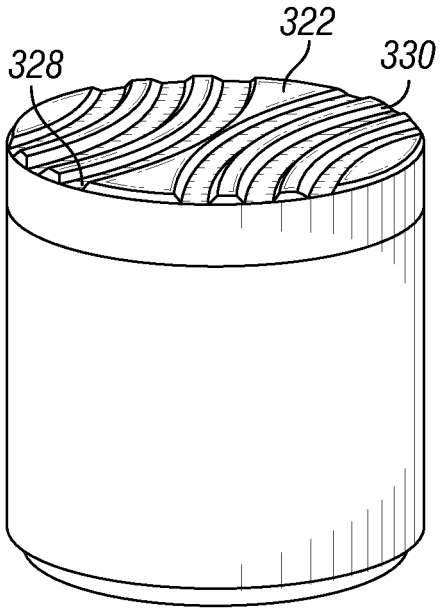

FIG. 8 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form a symmetrical pattern of spaced-apart circular regions of channels 328 and cutting face ridges 330 is shown in a configuration that comprises a majority of the cutting face 322. As shown, cutting face ridges 330 form channels 328 with a generally trapezoidal shaped profile. FIG. 8 illustrates an embodiment wherein the space between cutting face ridges 330 is greater than the space between the same element on FIG. 5, for example. Additionally, the profile of cutting face ridges 330 in FIG. 8 is generally flatter and less sloped than the same element on FIG. 5.

Figure 9:
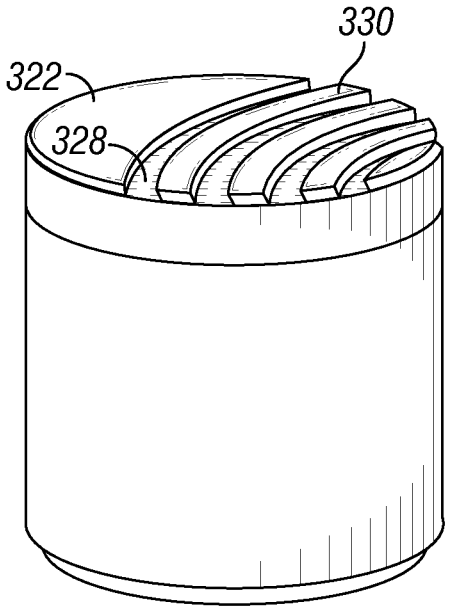

FIG. 9 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form an asymmetrical pattern of circular regions comprising only a portion of cutting face 322. The portion of the cutting face 322 that sits above channels 328 comprise cutting face ridges 330. As shown, cutting face ridges 330 form channels 328 with a generally rectangular shaped profile. As depicted, the space between cutting face ridges 330 is greater than the space between the same element on FIG. 5, for example.

Figure 10:
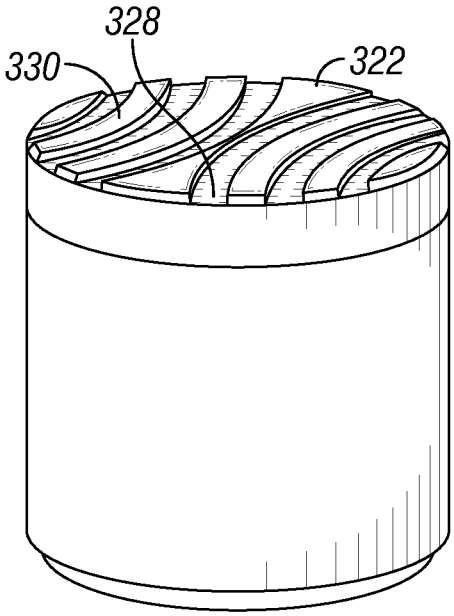

FIG. 10 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form a symmetrical pattern of spaced-apart circular regions of channels 328 and cutting face ridges 330 is shown in a configuration that comprises a majority of the cutting face 322. As shown, cutting face ridges 330 form channels 328 with a generally rectangular shaped profile.

Figure 11:
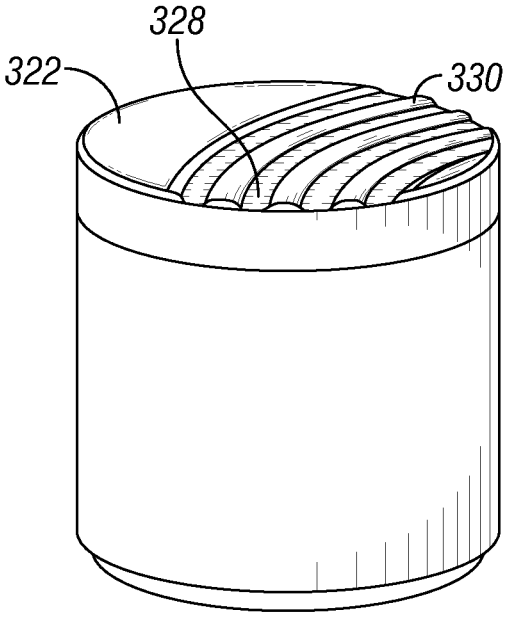

FIG. 11 illustrates a three-dimensional perspective view of another embodiment of cutting element 220 that may be used with the fixed-cutter drill bit 114 of FIG. 2. As shown, cutting face 322 includes one or more channels 328 which proscribe a curved arc that spans at least two portions of the periphery of the cutting face 322. The one or more channels 328 form an asymmetrical pattern of circular regions comprising only a portion of cutting face 322. The portion of the cutting face 322 that sits above channels 328 comprise cutting face ridges 330. As shown, cutting face ridges 330 form channels 328 with a generally rounded over shaped profile.

The preceding description provides various examples of the systems and methods of use disclosed herein which may contain different method steps and alternative combinations of components. Among other things, improvements over current wellbore drilling operations include direction of formation chip flow for improved drilling efficiency.

Statement 1. A method may comprise rotating a drill bit to extend a wellbore into a subterranean formation, flowing a drilling fluid through the drill bit, and directing a plurality of formation cuttings away from one or more cutting elements of the drill bit by moving the cuttings along one or more channels on at least a portion of a cutting face of the one or more cutting elements.

Statement 2. The method of statement 1, further comprising using the drilling fluid to remove the plurality of formation cuttings from the wellbore.

Statement 3. The method of statements 1 or 2, wherein the one or more channels are arcuate shaped.

Statement 4. The method of statements 1-3, wherein the one or more channels are oriented in a symmetric configuration.

Statement 5. The method of statements 1-4, wherein at least of the one or more channels includes a first portion and a second portion, where a depth of the first portion is greater than a depth of the second portion.

Statement 6. The method of statements 1-5, wherein the one or more channels have different depths.

Statement 7. The method of statements 1-3, wherein the one or more channels have uniform depths.

Statement 8. The method of statements 1-3 or 5-7, wherein the one or more channels are oriented in an asymmetric configuration.

Statement 9. The method of statements 1-8, wherein the one or more channels include multiple chamfers.

Statement 10. The method of statements 1-9, wherein the one or more cutting elements are chamfered along a periphery.

Statement 11. A drill bit may comprise a bit body, one or more blades attached to the bit body, one or more pockets formed in the one or more blades, one or more cutting elements fixed in the one or more pockets, wherein the one or cutting elements each have a cutting face with one or more channels formed in the cutting face.

Statement 12. The drill bit of statement 11, wherein the one or more channels are arc-shaped.

Statement 13. The drill bit of statements 11-12, wherein the one or more channels are chamfered.

Statement 14. The drill bit of statements 11-13, wherein the one or more cutting elements are chamfered along a periphery of the cutting face.

Statement 15. The drill bit of statements 11-14, wherein the one or more channels are symmetrically arranged in an actuate configuration.

Statement 16. The drill bit of statements 11-15, wherein the one or more channels have different depths.

Statement 17. The drill bit of statements 11-15, wherein the one or more channels have uniform depths.

Statement 18. The drill bit of statements 11-14 or 16-17, wherein the one or more channels are oriented in an asymmetric configuration.

Statement 19. The drill bit of statements 11-16 or 18, wherein a channel of the one or more channels includes a first portion and a second portion, where a depth of the first portion is greater than a depth of the second portion.

Statement 20. The drill bit of statements 11-20, wherein the one or more channels are arcuate shaped. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

rotating a drill bit to extend a wellbore into a subterranean formation;

flowing a drilling fluid through the drill bit; and directing a plurality of formation cuttings away from one or more cutting elements of the drill bit by moving the cuttings along two regions of arcuate channels and cutting face ridges on at least a portion of a cutting face of the one or more cutting elements, wherein the channels of each region of arcuate channels and cutting face ridges curve outwardly away from the channels of the other region of arcuate channels, wherein the arcuate channels each proscribe a curved arc that spans the cutting face between two portions of the periphery of the cutting face, and wherein the channels of each region of arcuate channels and cutting face ridges are radially spaced apart on the cutting face.

2. The method of claim 1, wherein the two regions of arcuate channels and cutting face ridges are symmetrical about an axis of symmetry between the two regions of arcuate channels and cutting face ridges.

3. The method of claim 1, wherein at least one of the channels includes a first portion and a second portion, where a depth of the channel varies along the cutting face such that a depth of the first portion is greater than a depth of the second portion.

4. The method of claim 1, wherein the channels have different depths.

5. The method of claim 1, wherein the channels have uniform depths.

6. The method of claim 1, wherein the symmetrical pattern of regions of arcuate channels and cutting face ridges cover a majority of the cutting face.

7. The drill bit of claim 1, wherein each region of arcuate channels includes three of the arcuate channels.

8. A drill bit comprising:

a bit body;

one or more blades attached to the bit body;

one or more pockets formed in the one or more blades;

one or more cutting elements fixed in the one or more pockets, wherein the one or more cutting elements each have a cutting face with two regions of arcuate channels formed in the cutting face configured to direct a plurality of formation cuttings away from the one or more cutting elements of the drill bit by moving the cuttings along one or more channels, wherein the channels of each region of arcuate channels curve outwardly away from the channels of the other region of arcuate channels, wherein the arcuate channels each proscribe a curved arc that spans the cutting face between two portions of the periphery of the cutting face, and wherein the channels of each region of arcuate channels and cutting face ridges are radially spaced apart on the cutting face.

9. The drill bit of claim 8, wherein the one or more cutting elements are chamfered along a periphery of the cutting face.

10. The drill bit of claim 8, wherein the two regions of arcuate channels are symmetrically arranged about an axis of symmetry between the two regions.

11. The drill bit of claim 8, wherein the channels have different depths.

12. The drill bit of claim 8, wherein the channels have uniform depths.

13. The drill bit of claim 8, wherein a channel of the channels includes a first portion and a second portion, where a depth of the channel varies along the cutting face such that a depth of the first portion is greater than a depth of the second portion.

14. The drill bit of claim 8, wherein each region of arcuate channels includes three of the arcuate channels.

15. The method of claim 8, wherein the symmetrical pattern of regions of arcuate channels and cutting face ridges cover a majority of the cutting face.

16. A method comprising:

rotating a drill bit to extend a wellbore into a subterranean formation;

flowing a drilling fluid through the drill bit; and directing a plurality of formation cuttings away from one or more cutting elements of the drill bit by moving the cuttings along two regions of arcuate channels and cutting face ridges on at least a portion of a cutting face of the one or more cutting elements, wherein the channels of each region of arcuate channels and cutting face ridges curve outwardly away from the channels of the other region of arcuate channels, wherein the arcuate channels each proscribe a curved arc that spans the cutting face between two portions of the periphery of the cutting face, and wherein the channels of each region of arcuate channels and cutting face ridges are spaced apart at a uniform distance on the cutting face.

17. A drill bit comprising:

a bit body;

one or more blades attached to the bit body;

one or more pockets formed in the one or more blades;

one or more cutting elements fixed in the one or more pockets, wherein the one or more cutting elements each have a cutting face with two regions of arcuate channels formed in the cutting face configured to direct a plurality of formation cuttings away from the one or more cutting elements of the drill bit by moving the cuttings along one or more channels, wherein the channels of each region of arcuate channels curve outwardly away from the channels of the other region of arcuate channels, wherein the arcuate channels each proscribe a curved arc that spans the cutting face between two portions of the periphery of the cutting face, and wherein the channels of each region of arcuate channels and cutting face ridges are spaced apart at a uniform distance on the cutting face.

* * * * *